US010000874B2

(12) United States Patent
Kim

(10) Patent No.: US 10,000,874 B2
(45) Date of Patent: Jun. 19, 2018

(54) TUBLESS WASHING MACHINE

(71) Applicant: Dongbu Daewoo Electronics Corporation, Seoul (KR)

(72) Inventor: Hye Ung Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 315 days.

(21) Appl. No.: 14/137,809

(22) Filed: Dec. 20, 2013

(65) Prior Publication Data

US 2015/0135779 A1 May 21, 2015

(30) Foreign Application Priority Data

Nov. 21, 2013 (KR) ..... 10-2013-0141926

(51) Int. Cl.

| | |
|---|---|
| ***D06F 21/02*** | (2006.01) |
| ***D06F 37/26*** | (2006.01) |
| ***D06F 37/22*** | (2006.01) |
| ***D06F 23/02*** | (2006.01) |
| ***D06F 37/04*** | (2006.01) |
| ***D06F 37/30*** | (2006.01) |

(52) U.S. Cl.

CPC ..... *D06F 21/02* (2013.01); *D06F 23/025* (2013.01); *D06F 37/04* (2013.01); *D06F 37/22* (2013.01); *D06F 37/268* (2013.01); *D06F 37/30* (2013.01)

(58) Field of Classification Search

CPC ..... D06F 21/02; D06F 21/04; D06F 23/025

See application file for complete search history.

(56) References Cited

U.S. PATENT DOCUMENTS

| | | | | |
|---|---|---|---|---|
| 4,704,879 | A * | 11/1987 | Christ | B02C 17/18 384/99 |
| 4,941,333 | A * | 7/1990 | Blessing | D06F 23/025 68/142 |
| 2007/0074543 | A1 * | 4/2007 | Lim | D06F 37/22 68/140 |

FOREIGN PATENT DOCUMENTS

| | | | |
|---|---|---|---|
| CN | 101922099 | A | 12/2010 |
| EP | 0381423 | A1 | 8/1990 |
| FR | 1193840 | A | 11/1959 |
| FR | 1379301 | A | 11/1964 |
| JP | 2004195053 | | 7/2004 |
| KR | 10-2000-0043392 | A | 7/2000 |
| KR | 1020010086011 | A | 9/2001 |
| KR | 1020050047766 | A | 5/2005 |

OTHER PUBLICATIONS

Jung, Yeong Jun; Drum Washer; Abstract of KR 10-2000-0043392; Jul. 16, 2000; http://kpa.kipris.or.kr.

* cited by examiner

*Primary Examiner* — Spencer E Bell

(57) ABSTRACT

The present disclosure relates to a tubless washing machine, and more particularly, to a tubless washing machine including only a drum without a tub containing wash water.

11 Claims, 8 Drawing Sheets

Prior Art

TUBLESS WASHING MACHINE

CROSS-REFERENCE TO RELATED APPLICATIONS

This application is based on and claims priority from Korean Patent Application No. 10-2013-0141926, filed on Nov. 21, 2013, the disclosure of which is incorporated herein in its entirety by reference.

TECHNICAL FIELD

The present disclosure relates to a tubless washing machine, and more particularly, to a tubless washing machine including only a drum without a tub containing wash water.

BACKGROUND

In general, washing machines may be classified into a pulsator-type washing machine, which uses or generates a water current by rotation of a pulsator on a bottom surface of a washing tub, an agitator-type washing machine, which uses a central agitator to wash laundry (e.g., using friction), and a drum type washing machine, which uses gravity (e.g., a vertical drop of the laundry resulting from rotation of a drum in the washing machine) to wash laundry.

A drum type washing machine is disclosed in various documents, including Korean Patent Registration No. 10-0400969 and the like, and the drum type washing machine in the related art includes each of a tub 11 containing wash water and a drum 12 inside a main body 10.

Accordingly, during washing, a door 18 in or on a front surface of the washing machine is opened, laundry is put into the tub 12, and water is supplied to the tub 12 after the laundry is put into the tub 12, to perform washing.

Power from a washing motor 13 is transferred to a drum shaft 15 through a belt 13*a*, so that the drum 12 is rotated, and a lifter 20 inside the drum 12 lifts and drops the laundry so that washing is performed.

A spring 9 and a damper 8 are connected to and support the drum 12 to attenuate vibrations generated by the rotation of the drum 12 during washing. The spring 9 and the damper 8 are generally fixed to the main body 10.

During spin-drying, a drain pump 17 is operated so that water is drained through a drain hole 16 and a drain hose 19 connected to a lower portion of the tub 11.

As described above, the drum type washing machine in the related art commonly further includes the tub 11 in addition to the drum 12. The reason is that the tub 11 contains the wash water, while washing is performed in the drum 12 inside the tub 11.

However, the tub 11 is generally formed of a plastic material, and accumulated mold, dirt or other foreign substances form in the tub 11 or on an inner surface of the tub 11 when the tub 11 is used over a long period of time. However, it is difficult to clean the tub 11, due to the presence of the drum 12. as a result, the unclean surface of the tub 11 may corrode, weaken, and/or contaminate the laundry (which may cause a skin irritation or disease).

The pulsator type washing machine as well as the drum type washing machine that include the tub may have such problems.

SUMMARY

The present disclosure has been made in an effort to provide a tubless washing machine including only a drum, without a tub containing wash water, as in the related art.

One or more embodiments of the present disclosure provide a tubless washing machine, including a main body; a drum in the main body, including an opening and a water supply and drain hole at one side or end of the drum, capable of being opened and closed; a driving shaft fixed to one of a front surface and a rear surface of the drum; a driven shaft fixed to the other of the front surface and the rear surface of the drum; a power transmission unit configured to transmit power to the driving shaft; and a pair of supports configured to rotatably support the driving shaft and the driven shaft.

In this case, each of the laundry insert opening and the water supply and drain hole may be in or at a curved side of the drum.

The tubless washing machine may further include a docking device configured to dock with or connect to the water supply and drain hole, and water may be supplied to the drum or drained from the drum through the docking device. In one embodiment, the water supply and drain hole comprises a water supply hole and a separate drain hole.

Each support may comprise crossing support frames that may have an X shape, and each of the driving shaft and the driven shaft may be attached at a crossing point of the crossing support frames.

A rotatable drum ring may be around and/or coupled to the drum at the side surface of the drum, and a suspension configured to attenuate vibrations during rotation of the drum may be on or attached to the drum ring.

A latch may be in or on the drum ring, and one end of the suspension may be attached to and/or assembled with the latch.

The suspension may include a spring and hooks at first and second ends of the spring, and a first hook at the first end of the spring may be attached to and/or assembled with the drum ring, and a second hook at the second end of the spring may be attached to and/or assembled with the main body.

According to exemplary embodiments of the present disclosure, it is possible to provide a function of a tub in the drum without using a tub, which may be formed of a plastic material or the like and become contaminated with mold or various foreign substances when the tub is used over a long period of time.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
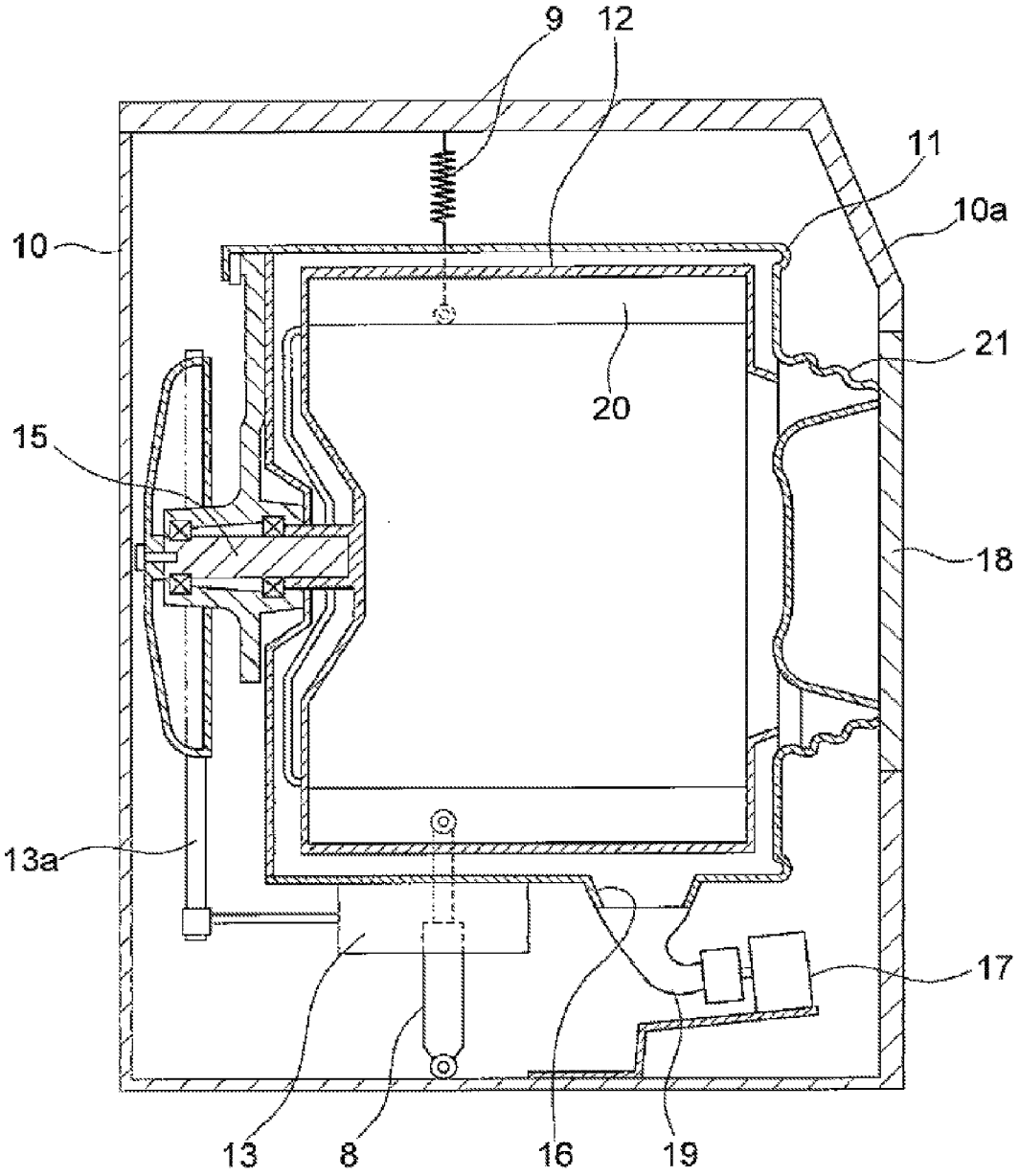
FIG. 1 is a configuration diagram illustrating a washing machine in the related art.

In the following detailed description, reference is made to the accompanying drawings, which form a part hereof The illustrative embodiments described in the detailed description, drawings, and claims are not meant to be limiting. Other embodiments may be utilized, and other changes may be made, without departing from the spirit or scope of the subject matter presented here.

Hereinafter, an exemplary tubless washing machine according to one or more embodiments of the present disclosure will be described in detail with reference to the accompanying drawings. As those skilled in the art will realize, the described exemplary embodiments may be modified in various different ways, all without departing from the spirit or scope of the present disclosure, which is not limited to exemplary embodiments described herein. A configuration and an operational effect according to exemplary configurations of the present disclosure will be clearly understood through the detailed description below. Like reference numerals designate like elements throughout the specification and drawings. A detailed explanation of known related functions and constitutions may be omitted when the detailed explanation obscures the subject matter of the present disclosure.

It is noted that the drawings are schematic and are not necessarily dimensionally illustrated. Relative sizes and proportions of parts in the drawings may be exaggerated or reduced in their sizes, and a predetermined size is just exemplary and not limiting.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
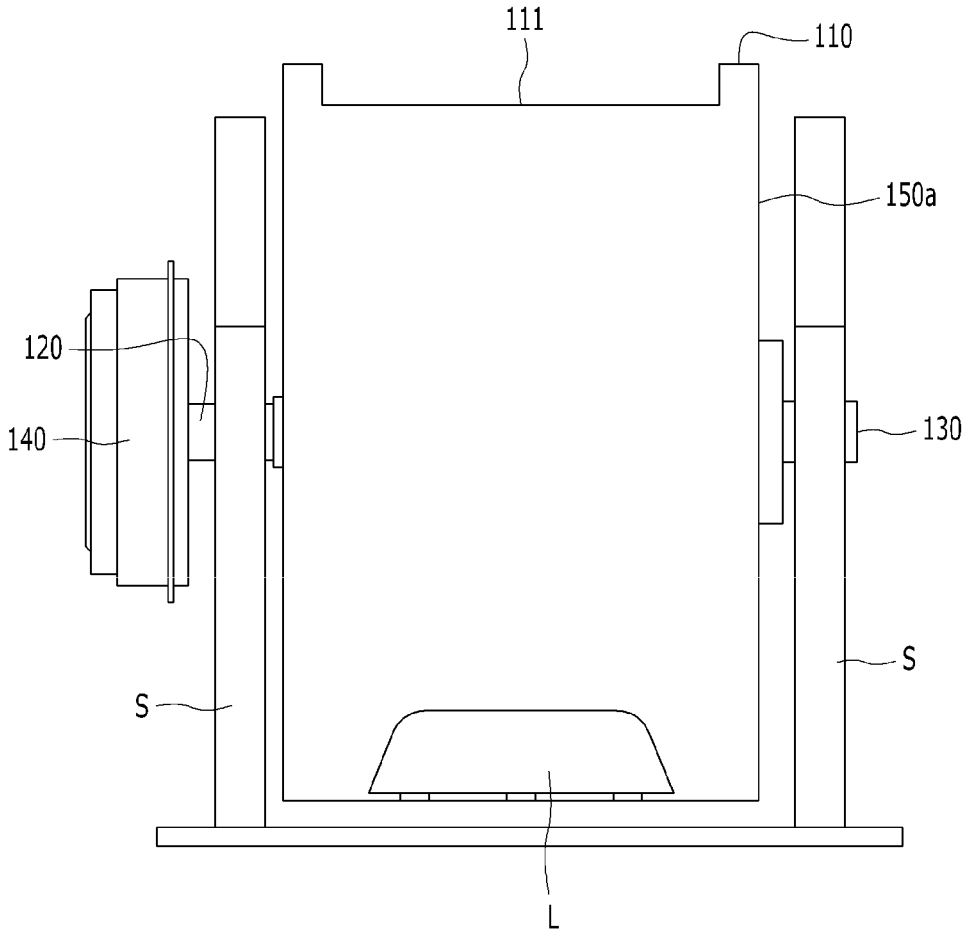
FIG. 2 is a side view illustrating an exemplary tubless washing machine according to one or more embodiments of the present disclosure.
Figure 3:
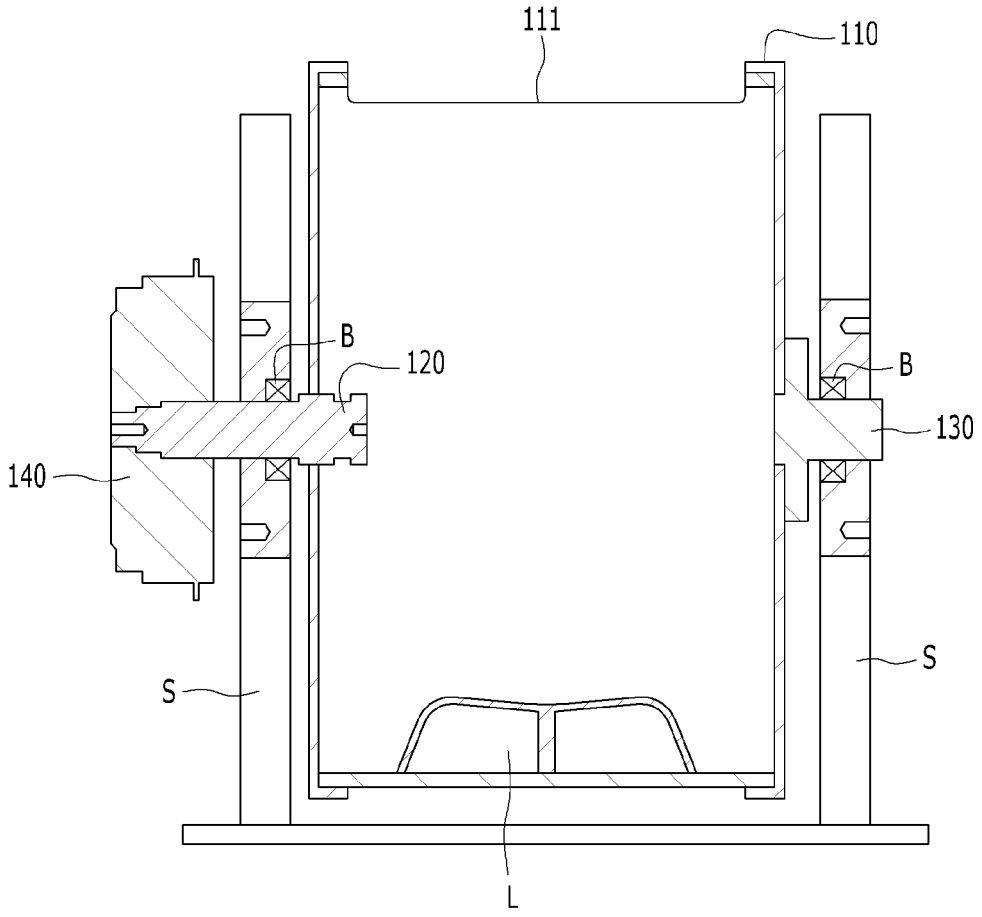
FIG. 3 is a side cross-sectional view illustrating the exemplary tubless washing machine according to embodiment(s) of the present disclosure.

First, as illustrated in FIGS. 2 and 3, a tubless washing machine 100 according to embodiments of the present disclosure includes a main body or exterior (not shown, but which may comprise a top panel or cover, front and rear panels or walls, and a pair of side walls or panels between the front and rear panels or walls), a drum 110, a driving shaft 120, a driven shaft 130, a power transmission unit 140, and one or more supports S.

In the present disclosure, a function of the tub in the related art is integrally performed by the drum 110. In the present embodiments, the tub 11 (see FIG. 1), which may be formed of a plastic material, and in which accumulated mold or various foreign substances may form, is not included. The drum 110 generally comprises a stainless material (e.g., stainless steel, a metal with a hardened ceramic coating, etc.), so that mold or other foreign substances do not form or adhere well to the inner surface of the drum 110.

In the aforementioned configuration, various shapes of washing machine main bodies are used. However, the main body in embodiments of the present disclosure includes a door through which laundry may be placed. The washing machine in the related art generally includes the door 18 (see FIG. 1) in or on a front panel thereof, so that laundry is put into the washing machine from the front, but in embodiments of the present disclosure, laundry is put into the washing machine from an upper side or top surface or panel of the washing machine, which may include or function as a lid or cover hingedly connected to the exterior of the washing machine.

The drum 110 rotates inside the washing machine main body so that washing and/or spin-drying is performed, and particularly, embodiments of the present disclosure do not include a tub, so that water is supplied into the drum 110 during washing, and water is drained from the drum 110 during spin-drying.

A lifter L is generally in and/or on an internal peripheral surface of the drum 110. The lifter L may have a substantially rectangular or trapezoidal shape (e.g., similar to a step) extending inward from the internal peripheral surface of the drum by a predetermined height, so that laundry being rotated by centrifugal force is lifted out of the wash water by the lifter L and then dropped back into the wash water after the leading side surface of the lifter passes a horizontal plane, thereby washing the laundry.

The drum 110 has an opening 111 through which laundry is put into the drum 110, and a water supply and drain hole (not illustrated) for supplying and draining wash water. The opening 111 and the water supply and drain hole may be at any side of the drum 110.

However, in order to easily put the laundry in the drum, the laundry insert opening 111 may be in a curved side wall of the drum 110. The curved side wall generally has a predetermined curvature as illustrated in the drawings. For example, the drum may have a substantially cylindrical shape with the curved side wall between the front and rear surfaces. The curved side wall may have a substantially circular cross-section.

When the laundry insert opening 111 is in the cylindrical side of the drum 110, the drum 110 rotates so that the opening 111 is at an upper part thereof, which can be controlled using a motor controller that controls an exact number of rotations of the drum during the washing, rinsing and spin-drying cycles, or using machine vision to determine a location or position of a feature on the drum (such as an edge of the opening 111) to control a starting and stopping position of the drum 110. The laundry may then be easily put in or taken out.

After the laundry is put in the drum, the opening 111 needs to be sealed in order to prevent water leakage from the drum. To this end, a first sealing door (not illustrated) is placed on or over the opening 111.

The first sealing door may comprise, for example, a sliding-type door having one or more seals along a border or periphery thereof, and/or that may slide into a self-sealing opening 111 (e.g., that includes a seal around its border or periphery that seals the door after it is slid into place). When the first sealing door is closed, the first sealing door is in close contact with the drum 110 and is sealed, so that the laundry insert opening 111 is completely sealed, thereby preventing water leakage and enabling washing operations in the drum.

Various types of sealing doors may be adopted as long as the sealing door provides acceptable sealing.

The water supply and drain hole may also be at the side surface of the drum 110. As will be described below, in order to stably rotate the drum 110, the driving shaft 120 and the driven shaft 130 are connected to front and rear surfaces of the drum 110, so that the water supply and drain hole can be placed at the side surface of the drum 110. Alternatively, in one embodiment, the water supply and drain hole is in or through the rear surface of the drum, and in an additional or alternative embodiment, the water supply and drain hole comprises a water supply hole and a separate drain hole. Each of the front and rear surfaces of the drum may comprise a closed and/or watertight end wall.

The present disclosure includes no tub, so water needs to be supplied to the drum 110 (which rotates during washing or spin-drying). Accordingly, embodiments of the present disclosure further include a docking device (not illustrated) configured to connect a water supply hose or pipe and a drain pipe to the water supply and drain hole. The drain pipe may be operably connected to a drain pump that removes the wash and/or rinse water from the drum 110 by pumping.

The docking device is connected with a hose for supplying water, so that after the docking device is docked or connected to the water supply and drain hole, water may be supplied through the water supply and drain hole into the drum 110 from an external water supply source and the hose.

Also, water may be drained from the drum 110 through the docking device when the docking device is connected to the water supply and drain hole, or water may be directly drained through the open water supply and drain hole without first connecting the docking device during the water drainage.

However, the water supply and drain hole may also include a second sealing door (not illustrated) capable of sealing the water supply and drain hole, and various types of second sealing doors, such as a sealing door that automatically opens and allows the docking device to be docked or connected to the water supply and drain hole, or a sealing door that is pushed, opened and/or entered by the docking device, may be used.

Embodiments of the present disclosure include a driving device (e.g., motor) for rotating the drum 110 during washing, rinsing and/or spin-drying. The driving device generally includes the driving shaft 120, the driven shaft 130, and the power transmission unit 140 (e.g., for transmitting power from a motor).

In this case, the driving shaft 120 may be fixed or attached to either the front surface or the rear surface of the drum 110, and the driven shaft 130 is fixed or attached to the other surface. The driving shaft 120 is connected to the power transmission unit 140 for transmitting the power from the motor to rotate the drum 110.

In one embodiment, water may be supplied to the drum 110 through an L-shaped pipe that passes through a sealed opening in a watertight plate covering the end of one of the shafts 120 and 130 (i.e., that extends into or interfaces with the drum). Inside the drum 110, the water supply pipe bends upward, and extends towards the uppermost surface in the drum 110. This water supply pipe may be capped with a sprayer configured to distribute the water relatively evenly over the laundry in the drum. Water may be removed from the drum 110 through a similar L-shaped pipe that passes through another sealed opening in a watertight plate covering the (internal) end of either the same one or the other one of the shafts 120 and 130. Inside the drum 110, the water removal pipe extends downward towards the lowermost surface in the drum 110. The water removal pipe may have a filter on or over the open end, configured to keep the laundry (or parts thereof) out of the pipe. The pipes are fixed in place by the sealed opening in the cap on or over the end of the corresponding shaft, and may comprise or be made from a relatively stiff material (e.g., polyvinyl chloride). Generally a bearing is between the cap and the shaft, to enable the shaft to rotate and the cap to remain fixed in place.

Each of the rotatable driving shaft 120 and driven shaft 130 is supported by a support S, and is assembled with the support S using a bearing B that enables the drum 110 to rotate. The pair of supports S are firmly fixed to the washing machine main body. Alternatively, the support S can comprise a single C-shaped or U-shaped unit supporting rotation of the shafts 120 and 130, and each support S may have a different form (such as inverse V-shaped, with a ring and/or bearing configured to receive the rotatable shaft at the upper point thereof, a substantially rectangular or semi-circular shape with a similar ring and/or bearing therein, etc.).

Figure 4:
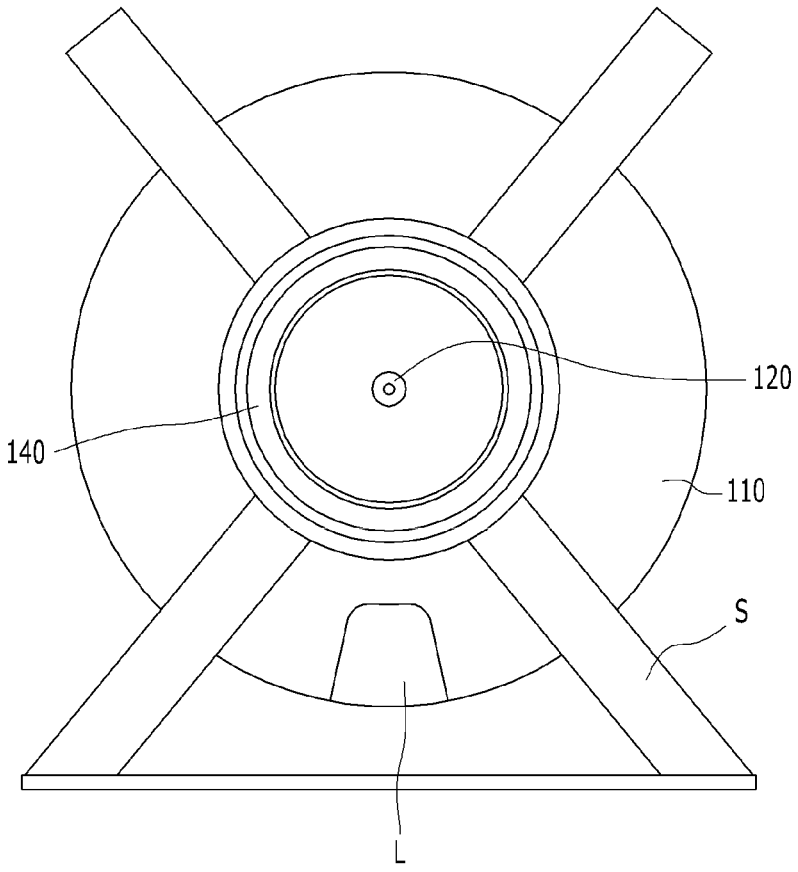
FIG. 4 is a front view illustrating the exemplary tubless washing machine according to embodiment(s) of the present disclosure.
Figure 5:
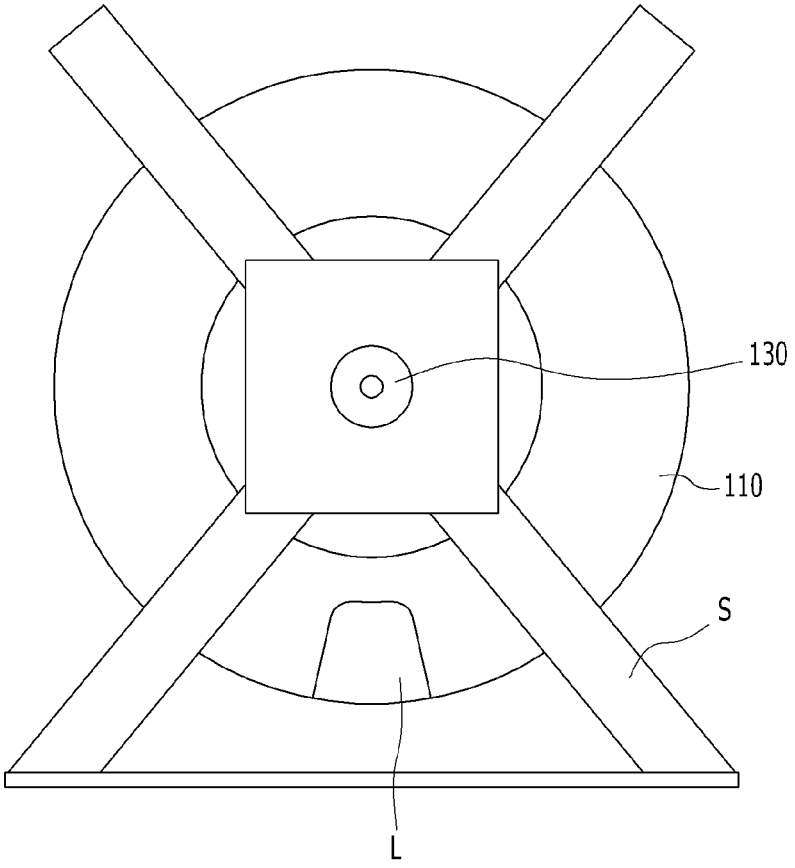
FIG. 5 is a rear view illustrating the exemplary tubless washing machine according to one or more embodiments of the present disclosure.

Particularly, as illustrated in FIGS. 4 and 5, the support S may comprise support frames or support frame members crossing in an X shape, and each of the driving shaft 120 and the driven shaft 130 may be attached at the crossing point of the support frames and/or members. The drum 110 may be further stably supported through the supports S having the aforementioned shape.

Hereinafter, a vibration attenuation apparatus for attenuating vibrations generated during rotation of the drum 110 having the aforementioned configuration will be described. The vibration attenuation apparatus includes one or more drum rings 150 and a suspension, and the suspension includes the spring device 160 and the damper 8 (see FIG. 1). In various embodiments, the suspension includes a plurality of spring devices 160 (e.g., 2, 4, etc.).

Figure 6:
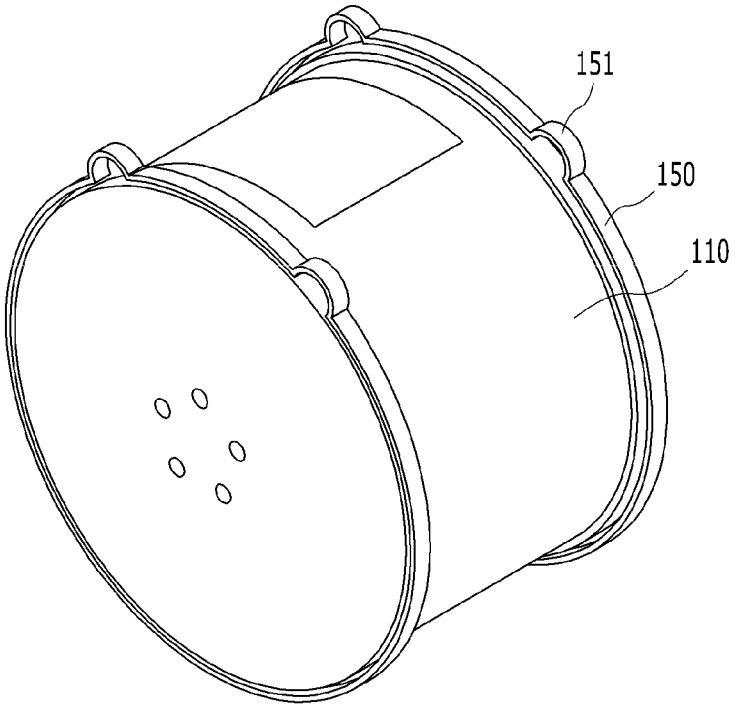
FIG. 6 is a perspective view illustrating an exemplary drum ring on an exemplary tubless washing machine according to one or more embodiments of the present disclosure.

As illustrated in FIG. 6, the drum ring assists a connection between the drum 110 and the suspension, and the ring-shaped or circular drum ring 150 is coupled to the drum 110 at the side surface of the drum 110. The suspension for attenuating the vibrations generated during rotation of the drum 110 is installed in or attached to the drum ring 150.

The drum ring 150 is shaped like a band and generally has a predetermined width. In this case, a guide groove may be formed along a circumference of the drum 110 on the side surface of the drum 110. Accordingly, the drum ring 150 may fit into the guide groove, and the guide groove stably supports the drum ring 150 without disturbing the rotation of the drum 110. There may also be one or more bearings between the side surface of the drum 110 and the drum ring 150 (e.g., in the guide groove).

Various apparatuses and/or methods, such as using a rail so that the drum 110 is rotatably assembled with the drum ring 150, may be applied to embodiments of the present disclosure as a matter of course.

In this case, latches or openings 151 extending away from the side of the drum 110 may be formed in the drum ring 150, and one end of the suspension may be latched or connected to and/or assembled with the latches/openings 151. In the drawing, the latch 151 may have a substantially semicircular or hemispherical shape, for example.

Figure 7:
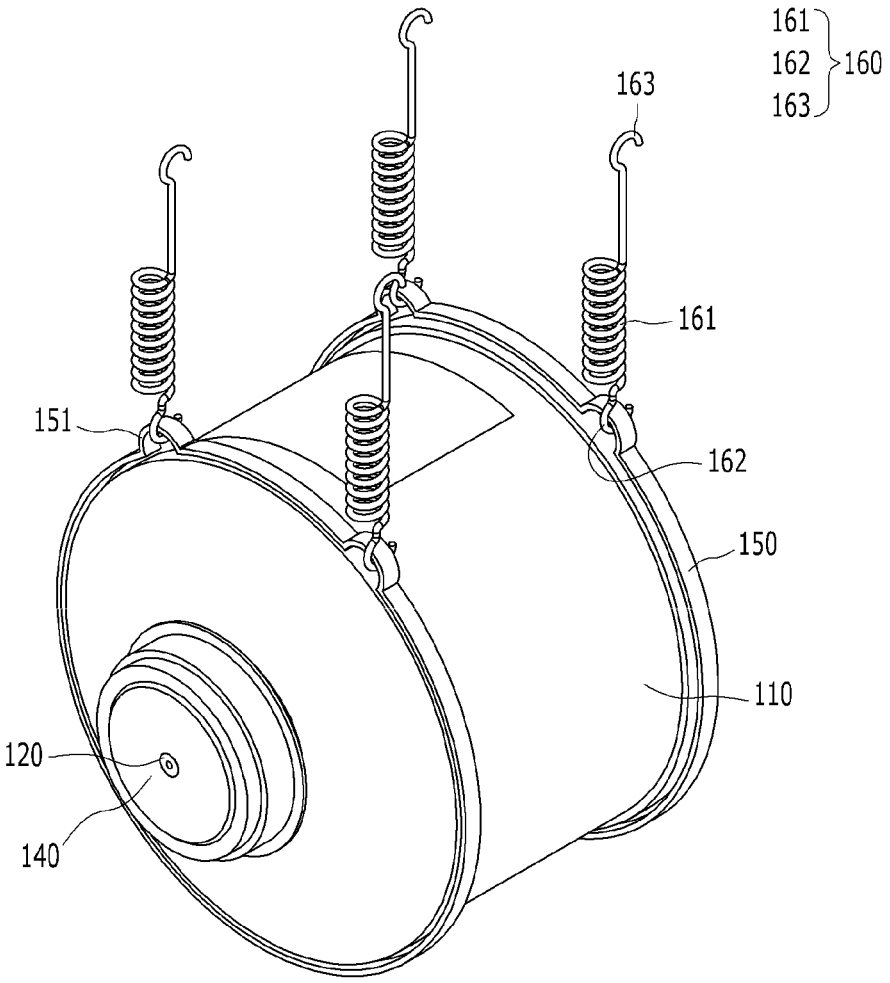
FIG. 7 is a diagram illustrating an exemplary suspension for the exemplary tubless washing machine according to an embodiment of the present disclosure.
Figure 8:
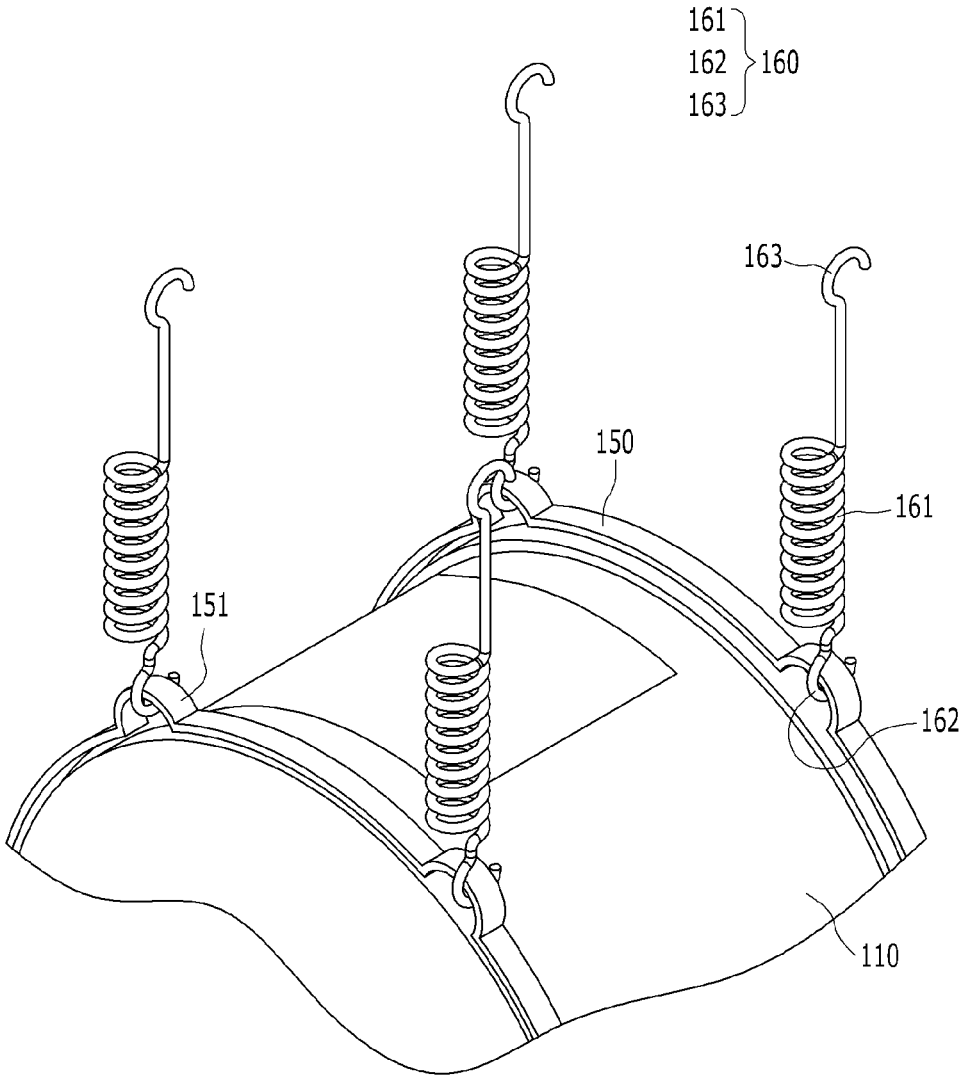
FIG. 8 is a partially enlarged view of FIG. 7.

As illustrated in FIGS. 7 and 8, the spring device 160 in the suspension may include a spring 161 (e.g., in a center part thereof), and hooks 162 and 163 at first and second ends of the spring 161, respectively.

When the hook 162 at one end of the spring 161 is latched or connected to and/or assembled with the latch 151 on or of the drum ring 150, and the hook 163 at the other end of the spring 161 is latched or connected to and/or assembled with the washing machine main body, the vibrations of the drum 110 are considerably decreased.

According to embodiments of the present disclosure, when the tubless drum 110 is used, it is possible to considerably attenuate the vibrations generated during the rotation of the drum 110 using a suspension specialized for the drum 110.

Specific exemplary embodiments of the present disclosure have been described. However, the spirit and the scope of the present disclosure are not limited to the disclosed embodiments, and those skilled in the art will appreciate that various modifications and changes are possible within the scope without changing the spirit of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A tubless washing machine, comprising:

a main body;

a drum inside the main body, including a water supply and drain hole at one side or end of the drum, the water supply and drain hole capable of being opened and closed;

an opening formed on a circumferential side surface of the drum;

a driving shaft fixed to one of a front surface and a rear surface of the drum;

a driven shaft fixed to the other of the front surface and the rear surface of the drum;

a power transmission unit configured to transmit power to the driving shaft;

a pair of supports configured to rotatably support the driving shaft and the driven shaft;

drum rings disposed on the circumferential side surface of the drum;

a pair of suspensions directly on or attached to the drum rings, configured to attenuate vibrations during rotation of the drum; and a latch extending away from the side of the drum in the drum rings, wherein an end of the suspensions is attached to and/or assembled with the latch, and wherein the drum rings are spaced apart from each other in the axial direction about the opening.

2. The tubless washing machine of claim 1, wherein the opening and the water supply and drain hole are positioned at or in a curved side of the drum.

3. The tubless washing machine of claim 1, further comprising: a docking device configured to dock with or connect to the water supply and drain hole, wherein water is supplied to the drum or drained from the drum through the docking device.

4. The tubless washing machine of claim 1, wherein each of the supports comprise crossing support frames.

5. The tubless washing machine of claim 4, wherein the crossing support frames have an X shape.

6. The tubless washing machine of claim 5, wherein each of the driving shaft and the driven shaft is connected at a crossing point of the crossing support frames.

7. The tubless washing machine of claim 1, wherein the pair of suspensions includes a spring and hooks at first and second ends of the spring, and a first hook at the first end of the spring is latched to and/or assembled with the drum rings, and a second hook at the second end of the spring is latched to and/or assembled with the main body.

8. The tubless washing machine of claim 1, wherein the drum has a substantially cylindrical shape with a curved sidewall between the front and rear surfaces, the curved sidewall having a substantially circular cross-section, and the water supply and drain hole is in the rear surface of the drum.

9. The tubless washing machine of claim 8, wherein each of the front and rear surfaces of the drum comprises a closed and/or watertight end wall.

10. The tubless washing machine of claim 1, wherein the water supply and drain hole comprises a water supply hole and a separate drain hole.

11. The tubless washing machine of claim 1, wherein water is supplied to the drum through an L-shaped pipe that passes through a sealed opening in a watertight plate covering the end of one of the driving shaft and the driven shaft.

* * * * *